US005135175A

United States Patent [19]

Trias

[11] Patent Number: 5,135,175

[45] Date of Patent: Aug. 4, 1992

[54] APPARATUS FOR CLEANING TEXTILE MACHINES AND A NOZZLE FOR USE IN SUCH AN APPARATUS

[76] Inventor: Jose R. Trias, Fontcuberta 24, Urbanizacion La Coromina, 08560 Manlleu, Barcelona, Spain

[21] Appl. No.: 615,426

[22] Filed: Nov. 16, 1990

[30] Foreign Application Priority Data

Feb. 16, 1990 [ES] Spain ..... 9000456

[51] Int. Cl.[5] ..... B05B 3/18; B05B 1/1

[52] U.S. Cl. ..... 239/750; 239/533.13; 239/602

[58] Field of Search ..... 15/312.2, 313; 239/750, 239/752, 734, 602, 533.13, DIG. 21, 751

[56] References Cited

U.S. PATENT DOCUMENTS 1,831,586 11/1931 Barr ..... 239/602
3,197,146 7/1965 King ..... 15/312.2 X
3,225,378 12/1965 Bottomley et al. ..... 15/312.2
3,600,224 8/1971 Silwell ..... 15/312.2 X

FOREIGN PATENT DOCUMENTS 196960 5/1923 United Kingdom ..... 239/533.13
467689 5/1974 United Kingdom ..... 239/DIG. 21

*Primary Examiner*—Andres Kashnikow
*Assistant Examiner*—Kevin P. Weldon
*Attorney, Agent, or Firm*—Michael J. Striker

[57] ABSTRACT

A pneumatic nozzle for use in an apparatus for cleaning textile machines comprises a frustum-shaped flattened tubular body made of a flexible material. The tubular body is inflatable upon flow of pressurized air therethrough whereat the tubular body takes a straight position, and deflatable upon ceasing of air flow therethrough whereat the tubular body takes a fall-down position. A neck is formed at one of the opposite ends of the tubular body and is associated with retaining and coating rings for securing the nozzle in a wall of blowing hose apparatus of the cleaning apparatus.

3 Claims, 2 Drawing Sheets

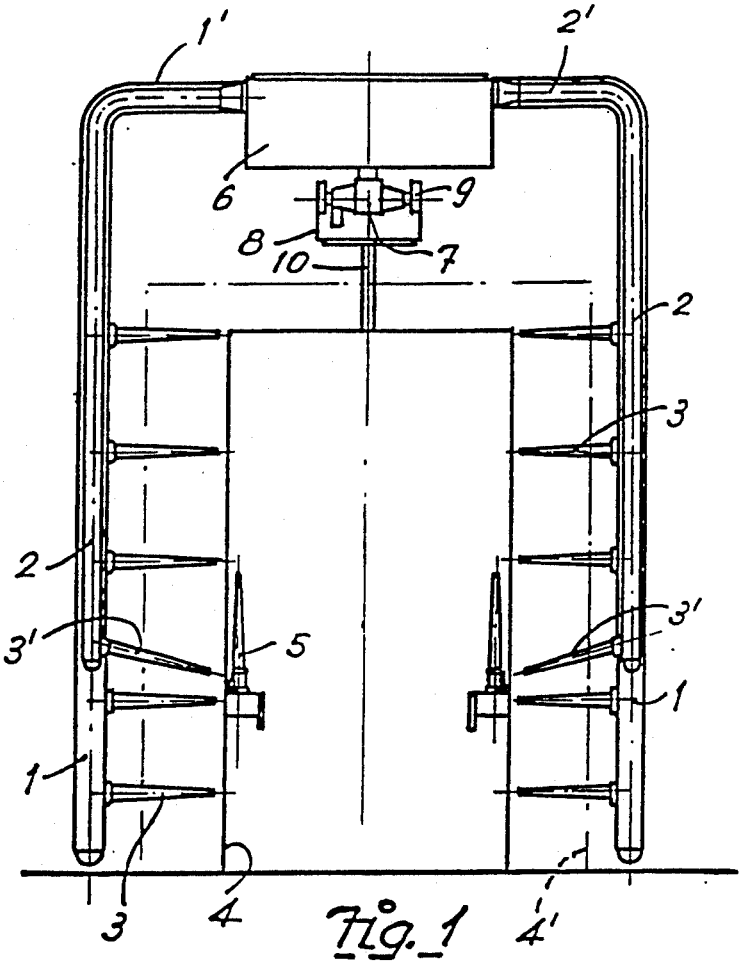
Fig. 1
Fig. 3
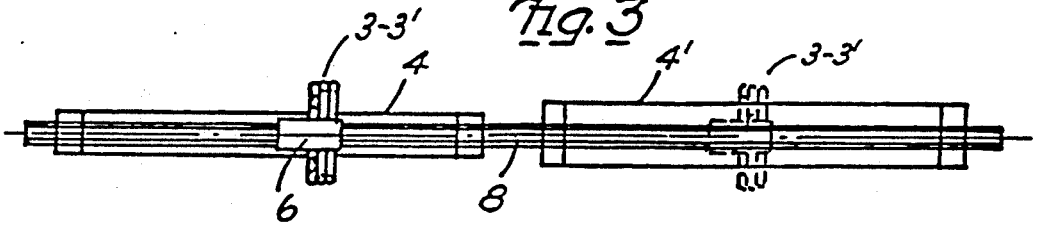

APPARATUS FOR CLEANING TEXTILE MACHINES AND A NOZZLE FOR USE IN SUCH AN APPARATUS

BACKGROUND OF THE INVENTION

The present invention relates to an apparatus for cleaning textile machines. In particular, the present invention relates to a nozzle for use in such cleaning apparatuses. In these apparatuses pneumatic nozzles are displaceable between an active straight (rigid and inflated) position and an inactive (deflated and fall-down) position. The nozzles are connected with hoses that hang on opposite sides of a textile machine to be cleaned, and are displaceable to accommodate the width of the machine and pass other obstacles that may be encountered when the apparatus passes past the textile machine. The nozzles serve to inject pressurized air for cleaning surfaces of the textile machine and for eliminating the rest of threads at bottoms of spindles of the textile machines to be cleaned.

At present, several systems with displaceable nozzles are known in which the nozzles are displaceable upon encountering an obstacle during displacement of the cleaning apparatus past a textile machine. The known displaceable nozzle systems are usually of a mechanical type in which the nozzles are automatically displaced by appropriate drive means when encountering an obstacle having a width that is larger than the width between the nozzles in a working or active position thereof..

The systems described above are disclosed in Spanish Patents 88.03601, 88.03845, 88.03846, and 89.01349 all issued to the applicant herein. These patents describe and claim several solutions that permit to achieve a complete cleaning of a textile machine without any hazard to the nozzles of the displaceable hoses and wherein a collision between nozzles and a textile machine or other obstacle is prevented.

SUMMARY OF THE INVENTION

The object of the invention is a nozzle for use in a cleaning apparatus in which the mechanical drive means for displacing nozzles between active and inactive positions thereof are eliminated.

The object of the invention is achieved by providing a nozzle system in which orientation of the nozzles is controlled by appropriate injection of air and without use of any auxiliary means. Such orientation can be effected only with use of flexible nozzles that can adopt a straight or inflated position (upon being injected with air) and a fall-down or deflated position (upon ceasing the air injection). In their straight position, the nozzles are sufficiently rigid for enabling flow of a stream of air to a cleanable area. Upon ceasing the air injection, the nozzles loose their rigidity and fall down under their own gravity so that the distance between opposite nozzles increases. The return to a straight position is insured by new injection of air.

Thus, the present invention provides automatic and reliable means for controlling nozzle orientation (displacement) without drawbacks associated with the use of mechanical drive means.

The present invention both as to its construction as to its method of operation, together with additional objects and advantages thereof, will be best understood from the following detailed description of specific embodiments when read in connection with the accompanying drawings.

BRIEF DESCRIPTION OF THE DRAWINGS

FIG. 1 shows a schematic elevational view of an apparatus equipped with a plurality of nozzles according to the present invention with the nozzles in a straight or inflated position thereof;

FIG. 3 shows an explanatory view showing displacement of nozzles when passing a narrow textile machine to be cleaned (left view) and a wider textile machine (right view);

DETAILED DESCRIPTION OF THE PREFERRED EMBODIMENTS

Figure 2:
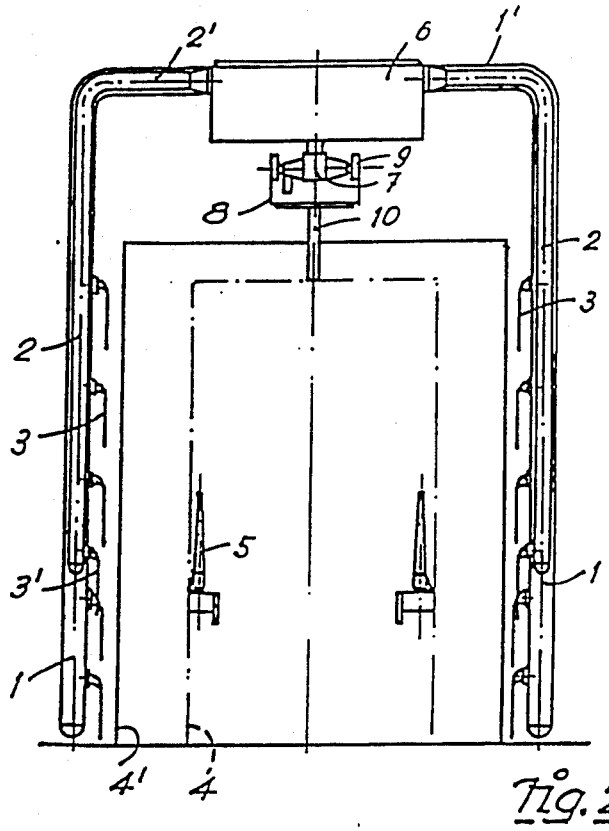
FIG. 2 shows the same view as FIG. 1 but with the plurality of nozzles in a fall-down or deflated position.

The apparatus shown in FIG. 1 comprises main blowing hanging hoses 1 and 2. The blowing hoses 1 are equipped with a plurality of nozzles 3 for cleaning opposite sides of a respective textile machine. The textile machine may have a comparatively narrow width, as designated by a continuous line 4 in FIGS. 1 and 3, or a wider width, as designated by a dash and dot line 4' in FIGS. 1 and 3. Alternatively, the dash and dot line 4' may designate other obstacles encountered by the nozzles when they move past the cleanable textile machine. The blowing hoses 2 have a length which is less than the length of hoses 1 and carry inclined end nozzles 3' which are directed toward bottoms of spindles 5 of the textile machine where thread rest accumulates.

The hoses 1 and 2 are connected by elbows 1' and 2', respectively, with a source of pressurized air which includes an overpressure box 6 connected with a not shown air supply line. The overpressure box is supported on a carriage 7 displaceable along guide ways. The carriage 7 has roller means 9 or the like for displacement along the guideways 8. The guideways 8 are mounted on a support 10 extending along a row of textile machines.

Figure 4:
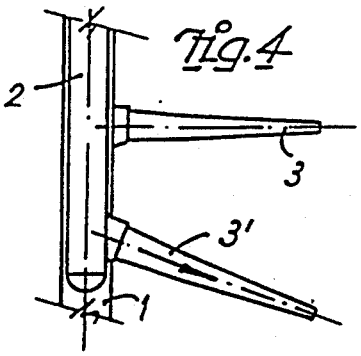
FIG. 4 shows a partial elevational view of the apparatus according to the invention with the nozzles in straight or in inflated position.
Figure 5:
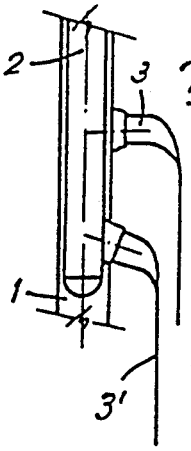
FIG. 5 shows a partial elevational view of the apparatus according to the invention with the nozzles in a deflated of fall-down position.

According to the present invention, the nozzles are not permanently in a rigid condition, but occupy alternatively the straight position as shown in FIGS. 1 and 4, or a fall down position as shown in FIGS. 2 and 5. The nozzles remain in the straight inflated position only for the time required for effecting an appropriate cleaning of the textile machine.

Figure 6:
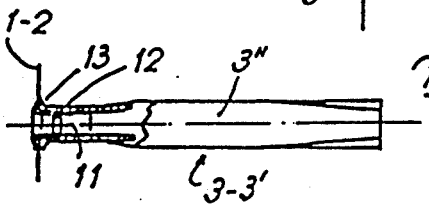
FIG. 6 shows a partially cross-sectional plan view of a nozzle used in apparatus according to the present invention.

As shown in FIG. 6, a nozzle according to the present invention comprises a flattened tubular body 3'' formed of two flexible sheets made of an appropriate material such as rubber, plastified fabric, plastic or the like. The sheets are welded along their longitudinal sides and, in absence of internal pressure, are in a collapsed condition. The nozzles are frustum shaped to provide for best flow of an air stream. At one of its ends, the tubular body 3'' has an annular neck 11 and is surrounded by an O-ring 12 and a closing and coating ring 13. The end construction of the nozzles insures their reliable connection with a blowing hose.

When air is injected under pressure into the nozzles 3 and 3'. they automatically inflate and occupy a straight position shown in FIGS. 1 and 4. The air is delivered from the overpressure box 6. As long as air is injected, the nozzles remain in the straight inflated position, and air streams are directed through the nozzles onto the cleanable textile machine.

When the cleaning apparatus in its movement encounters an obstacle, the air injection is stopped, and the nozzles are deflated and fall down, due to the material flexibility, under their own weight.

As can be seen from the foregoing description, the present invention provides simple and reliable means for cleaning textile machines having different widths, or when radially projecting obstacles are encountered by the cleaning apparatus in its movement.

While the invention has been illustrated and described as embodied in an apparatus for cleaning textile machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A pneumatic nozzle for use in an apparatus for cleaning textile machines and having blowing hose means, said pneumatic nozzle comprising a frustum-shaped flattened tubular body having opposite ends including a wider end and a narrower end and made of a flexible material, said tubular body being inflatable upon flow of pressurized air therethrough whereat said tubular body takes a straight position, and deflatable upon ceasing of air flow therethrough whereat said tubular body takes a fall-down position; a neck at said wider end; securing means associated with said neck for securing said nozzle in a wall of the blowing hose means of the cleaning apparatus.

2. An apparatus for cleaning textile machines, comprising a carriage movable on guideway means extending along a row of textile machines; opposite blowing hoses connected with said carriage for displacement therewith and hanging on opposite sides of the textile machine; means for supporting said opposite blowing hoses on said carriage; a plurality of pneumatic nozzles secured to said opposite blowing hoses adapted to supply pressurized air to textile machines without contacting the latter, each of said pneumatic nozzles comprising a frustum-shaped flattened tubular body having opposite ends and made of a flexible material, said tubular body being inflatable upon flow of pressurized air therethrough whereat said tubular body takes a straight position, and deflatable upon ceasing of air flow therethrough whereat said tubular body takes a fall-down position, a neck at a wider one of said securing means associated with said neck for securing said nozzle in a wall of a respective blowing hose; and pressurized air supply means supported on said carriage for delivering pressurized air to said nozzles.

3. An apparatus for cleaning textile machines, comprising a carriage movable on guideway means extending along a row of textile machines; a plurality of opposite blowing hose connected with said carriage for displacement therewith and hanging on opposite sides of the textile machine; means for supporting said opposite blowing hoses on said carriage; a plurality of pneumatic nozzles secured to said opposite blowing hoses and adapted to supply pressurized air to textile machines without contacting the latter, each of said pneumatic nozzles comprising a frustum-shaped flattened tubular body having opposite ends and made of a flexible material, said tubular body being inflatable upon flow of pressurized air therethrough whereat said tubular body takes a straight position, and deflatable upon ceasing of air flow therethrough whereat said tubular body takes a fall-down position, said nozzles include first nozzles extending substantially perpendicularly to said blowing hoses and second nozzles extending inclinedly to said blowing hoses.

* * * * *